United States Patent [19]

Dätwyler

[11] Patent Number: 4,599,944

[45] Date of Patent: Jul. 15, 1986

[54] WRAP-ON PRINTING PLATE STRUCTURES AND ASSEMBLIES

[75] Inventor: Max Dätwyler, Langenthal, Switzerland

[73] Assignee: MDC Max Dätwyler Bleienbach AG, Bleienbach, Switzerland

[21] Appl. No.: 600,365

[22] Filed: Apr. 16, 1984

[30] Foreign Application Priority Data

Apr. 19, 1983 [DE] Fed. Rep. of Germany ..... 3314083

[51] Int. Cl.[4] ..... B41F 27/06

[52] U.S. Cl. ..... 101/378; 101/382 R

[58] Field of Search ..... 101/150, 327, 328, 368, 101/375, 382 R, 395, 401, 401.1, 401.2, 407 A, 415.1, DIG. 12, 376, 378

[56] References Cited

U.S. PATENT DOCUMENTS 605,894 6/1898 Murray ..... 101/395
801,291 10/1905 Wood ..... 101/401.2 X
1,477,619 12/1923 Wood ..... 101/395
2,474,889 7/1949 Crafts ..... 101/378
4,157,067 6/1979 Datwyler ..... 101/415.1
4,437,942 3/1984 Datwyler ..... 204/6

FOREIGN PATENT DOCUMENTS 2804304 8/1978 Fed. Rep. of Germany .
147482 8/1931 Switzerland ..... 101/375

*Primary Examiner*—Charles A. Pearson
*Attorney, Agent, or Firm*—Benoit Law Corporation

[57] ABSTRACT

A flexible wrap-on printing plate structure has a flexible printing plate body extending between opposite first and second edges at which the printing plate structure is attached to a rotary printing form cylinder. A thickening of the printing plate body or other means extend along a third edge of the printing plate body between the mentioned first and second edges for mechanically stiffening the printing plate body along that third edge, so that no warping of the printing plate structure and no printout of printing plate margins can occur.

9 Claims, 4 Drawing Figures

Fig. 1
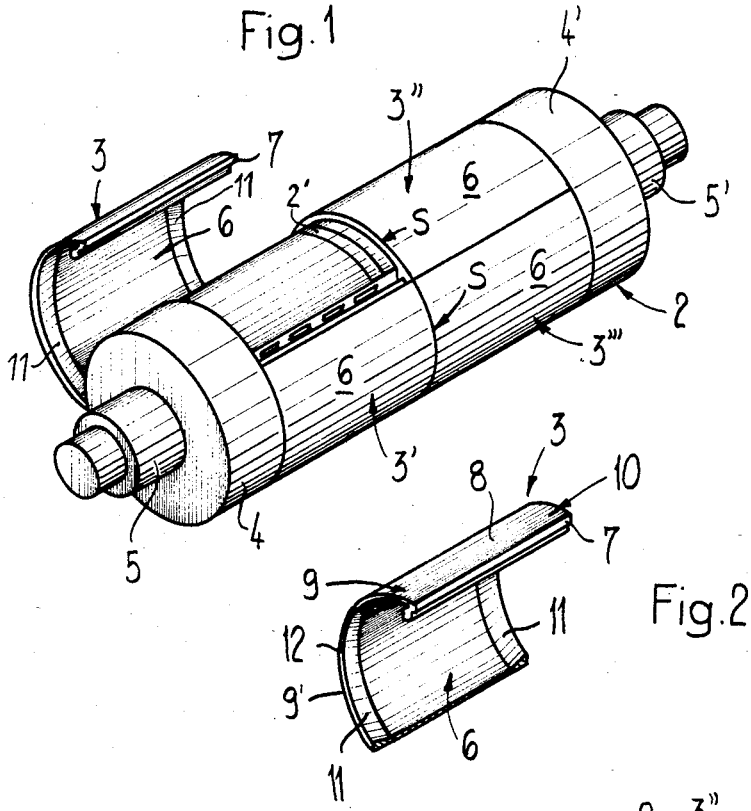
Fig. 2
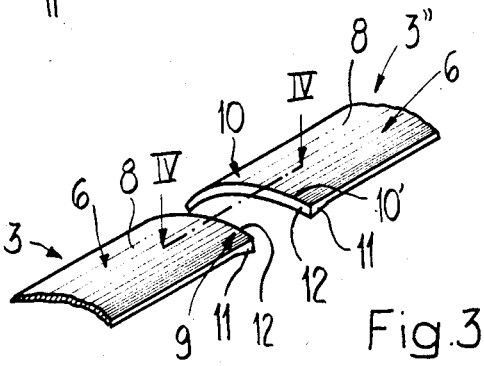
Fig. 3

WRAP-ON PRINTING PLATE STRUCTURES AND ASSEMBLIES

BACKGROUND OF THE INVENTION

1. Field of the Invention

The subject invention relates to printing equipment and more specifically, to wrap-on printing plate systems, structures and assemblies.

2. Information Disclosure Statement

Rotogravure printing is becoming increasingly preferred over offset printing where high printing printing quality is important, especially for long printing runs. Rotogravure printing also turns out to be more economical than offset printing, when high quality is to be maintained throughout extremely long runs.

However, unlike offset printing, rotogravure printing has lacked flexibility. In this respect, recent years have seen an increasing demand for items of regional interest and for local advertisements in national newspapers and periodicals. This demand has been paralleled by an increasing need for effective language or text changes, or listings of such items as prices and firm names, in larger, otherwise unaltered catalogs or other texts. These and other changes in copy, page insertions and regional advertisements are costly to the gravure printer in production time and expense.

A solution to this problem has been seen in providing a rotogravure system with exchangeable printing plates which may be wrapped onto the printing cylinder so as to permit localized changes to be effected thereon without replacement of an entire printing cylinder. The term "wrap-on" is employed herein generically, to extend at least to wrap-around plate systems and to systems in which the printing plate is only wrapped on part of the form cylinder.

Such wrap-on printing plates form elements, as for instance known from my U.S. Pat. No. 4,157,067, issued June 5, 1979, and its corresponding German Patent Publication, DE-OS No. 28 04 304, should be as thin as possible for weight saving reasons and particularly so as to be clampable evenly onto the printing form cylinder and to fit everywhere tightly onto that form cylinder. In addition, care must be taken that the butt joints between clamped-on printing plates are as closed or tight as possible in the axial direction as well as in the circumferential direction of the printing form cylinder, so that practically no printing ink can intrude the butt joints and be deposited there.

In my above mentioned U.S. Pat. No. 4,157,067, including FIGS. 8, 9 and 10 thereof, a seal for the circumferential butt joints has been previously proposed by either a canting of the printing plates at their side edges in order to form a hollow space for the reception of a seal, or by providing slots in the printing cylinder in which seals are installed. In practice, such constructions are expensive from a production point of view and the seals used therein require maintenance.

In addition, as shown with the aid of FIG. 7 of my above mentioned U.S. Pat. No. 4,157,067, I have tried to provide the side edges of wrap-on printing plates with sealing surfaces and to attain a sealing of the butt joints by joining the sealing surfaces of adjacent wrap-on printing plates tightly together. However, in extensive printing operations, such a solution was not able completely to avoid the deposit of printing ink in the butt joints because a continous tight contact of the sealing surfaces of the adjacent wrap-on printing form elements cannot be guaranteed throughout the printing process. In practice, such ink deposits leave undsirable marks on printed products.

Reference may also be had to my U.S. Pat. No. 4,437,942, issued Mar. 20, 1984, and disclosing methods and apparatus for producing wrap-on printing plates with clamping bars, and such printing plates produced by such methods and apparatus.

SUMMARY OF THE INVENTION

It is a general object of this invention to overcome the disadvantages and meet the needs expressed or implicit in the above Information Disclosure Statement or in other parts hereof.

It is a related object of this invention to provide improved wrap-on printing plate systems, structures and assemblies.

It is a germane object of this invention to simplify the design and manufacture of wrap-on printing plates while inhibiting the intrusion of printing ink between adjacent clamped on printing plates without resort to additional sealing means.

It is a related object of this invention to prevent the transition from one wrap-on printing plate to the adjacent wrap-on printing plate from making itself noticeable on the printed product.

Other objects of this invention will become apparent in the further course of this disclosure.

From one aspect thereof, the subject invention resides in a flexible wrap-on printing plate structure for a rotary printing form cylinder, comprising, in combination, a flexible printing plate body extending between opposite first and second edges, means at these first and second edges for releasably attaching the printing plate structure to the form cylinder, and means extending along a third edge of the printing plate body between the first and second edges for mechanically stiffening the printing plate body along that third edge including along the third edge a first thickening of the printing plate body having a first lateral abutment surface having a height greater than a thickness of the printing plate body.

From a related aspect thereof, the subject invention resides in a printing plate assembly, comprising in combination a rotary printing form cylinder, a first flexible wrap-on printing plate structure having a first flexible printing plate body extending between opposite first and second edges of the first printing plate structure and being attached to that rotary printing form cylinder along the first and second edges of that first printing plate structure, a second flexible wrap-on printing plate structure having a second flexible printing plate body extending between opposite first and second edges of the second printing plate structure and being attached to the rotary printing form cylinder along the first and second edges of that second printing plate structure and abutting along a third edge of the second printing plate structure a third edge of the first printing plate structure extending between the first and second edges of said first printing plate structure, means extending along the third edge of the first printing plate structure and abutting the form cylinder for mechanically stiffening the first printing plate structure along that third edge of the first printing plate structure including a first thickening of the first printing plate structure along the third edge of the first printing plate structure having a first lateral abutment surface of a height greater than a thickness of the first printing plate body and means extending along the third edge of the second printing plate structure and abutting the form cylinder for mechanically stiffening the second printing plate structure along that third edge of the second printing plate structure including a second thickening of the second printing plate structure along the third edge of the second printing plate structure having a second lateral abutment surface abutting the first lateral abutment surface and having a height greater than a thickness of the second printing plate body.

BRIEF DESCRIPTION OF THE DRAWINGS

The subject invention and its various objects and aspects will become more readily apparent from the following detailed description of preferred embodiments thereof, illustrated by way of example in the accompanying drawings, in which:

FIG. 1 is a perspective view of a printing form cylinder with clamped-on wrap-on printing plates, as well as a wrap-on printing plate shown in the process of being clamped onto the form cylinder;

FIG. 2 is a wrap-on printing plate of the type shown in FIG. 1, and shown with one end cut off for better visibility of the lateral edge regions according to an embodiment of the subject invention;

FIG. 3 is a detail view, with parts broken away, of two adjacent wrap-on printing plates according to an embodiment of the subject invention and separated from each other for better visibility of the lateral edge regions.

DESCRIPTION OF PREFERRED EMBODIMENTS

Figure 4:
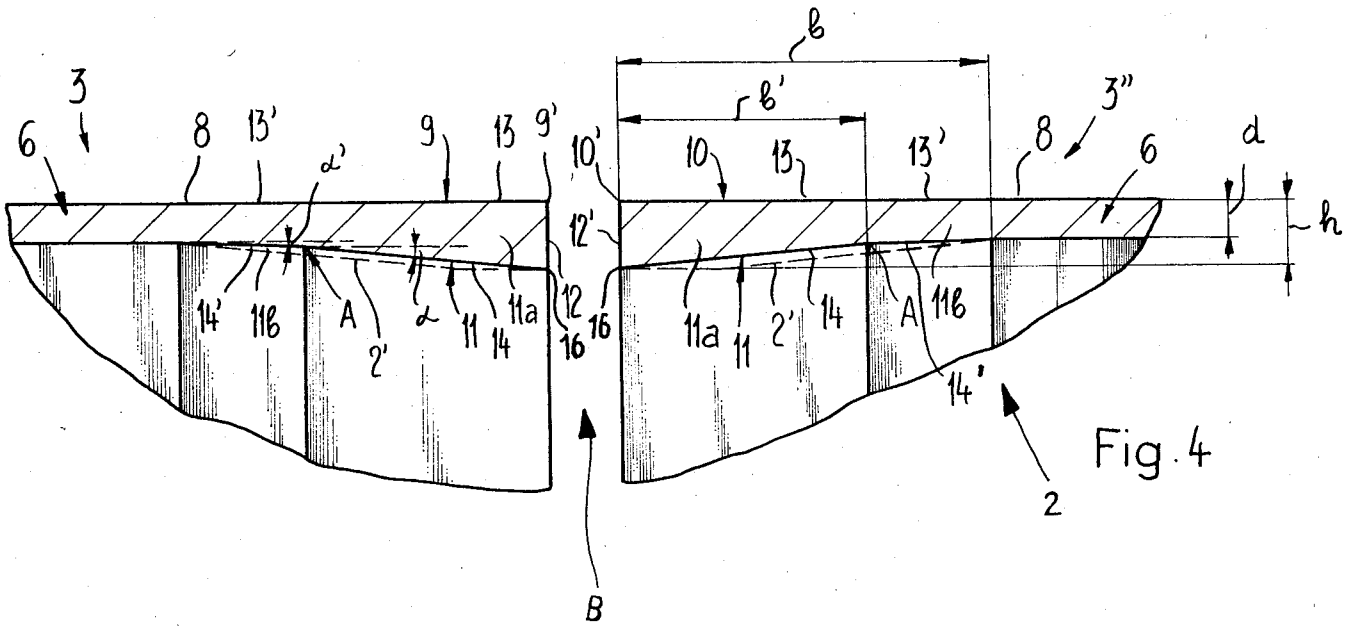
FIG. 4 is a section on an enlarged scale along line IV—IV of FIG. 3.

FIG. 1 shows a rotogravure cylinder assembly comprising a rotary printing form or base cylinder 2 with four flexible wrap-on printing plate structures or elements 3, 3', 3'', 3''', of which element 3 is shown partially lifted off, or in the process of being clamped onto the form cylinder, while the elements 3', 3'' and 3''' are shown in their clamped-on position. The printing form cylinder 2 has two side flanges 4 and 4' between which the wrap-on printing plate elements 3, 3', 3'', 3''' are arranged. Two stub shafts 5, 5' serve as rotary mounting supports of the printing cylinder assembly.

Each of the structurally corresponding wrap-on printing plate elements 3, 3', 3'', 3''', whose construction is more clearly seen in FIGS. 2 to 4, has a flexible printing plate body 6 of a thickness d (FIG. 4) preferably between 0.5 mm and 0.7 mm or about 0.6 mm. Each printing plate body 6 extends between first and second edges at which clamping bars are located as, for instance, seen in my above mentioned U.S. Pat. Nos. 4,157,067 and 4,437,942 herewith incorporated by reference herein. Only one of these clamping bars 7 is visible in FIGS. 1 and 2.

As disclosed in my above mentioned patents, clamping bars 7 serve as means at the first and second edges of each printing plate body 6 for releasably attaching the particular printing plate structure 3 to 3''' to the form cylinder 2. In other words, the wrap-on printing plate structures are attached by clamping bars 7 which extend in axial direction of the printing form cylinder 2, as do the above mentioned first and second edges of each clamped-on printing plate body 6.

On the inside of the printing form cylinder 2, a tension mechanism (not shown) which may be of a conventional type, such as disclosed in my above mentioned patents, is provided for engaging each element 3 to 3''' at its clamping bars 7 and tensioning that printing plate element against or onto the form cylinder 2.

The surface of the printing plates 6, which is formed as a segment of the cylinder surface, is designated in FIGS. 2 to 4 as 8.

According to the subject invention, means extend along a third edge 9', and preferably also along a fourth edge 10', of each printing plate body 6 between its above mentioned first and second edges for mechanically stiffening that printing plate body along said third and fourth edges 9', 10'; with that third and fourth edges extending preferably at right angles to at least one of the above mentioned first and second edges.

According to a preferred embodiment of the subject invention, the mechanical stiffening means include a thickening 11 of the printing plate body 6 along its third and for fourth edge 9', 10'extending preferably rectangularly to the clamping bars 7. In order to form such a thickening 11 each printing plate body 6 increases its thickness gradually in marginal regions 9 and 10 towards its side edges 9', 10'.

In other words, the means for mechanically stiffening the printing plate body 6 include a gradual thickening 11 of said printing plate body toward the third edge 9' and/or fourth edge 10'.

According to another preferred embodiment of the invention, the means for mechanically stiffening the printing plate body 6 include a corner section A extending along that printing plate body parallel to the third edge 9' at a distance therefrom. In the illustrated preferred embodiment, the means for mechanically stiffening the said printing plate body 6 include successive different first and second thickenings **11*a* and 11*b* of the printing plate body extending jointly along the third edge 9'**.

The second thickening **11*a* extends from said first thickening 11*b* to the third edge 9' and is preferably stronger than the first thickening 11*b*. In the illustrated preferred embodiment, the first and second thickenings 11*a* and 11*b* jointly form a corner A therebetween extending along the printing plate body 6 parallel to the third edge 9'** at a distance therefrom.

The illustrated thickenings 11 are formed of two joining segments **11*a* and 11*b*. The transition from one segment 11*a* to the other segment 11*b* is designated with A in FIG. 4, and forms the above mentioned stiffening corner in printing plate body 6. On each thickening 11, that is on the third or fourth edge 9' or 10' or on the externally positioned segment 11*a*, a lateral abutment surface 12 or 12' is provided. In the illustrated preferred embodiment, the abutment surface 12 has a height h greater than a thickness d of the printing plate body. By way of preferred example, the height of the lateral abutment surface 12 or 12' is between 0.8 and 1.5 mm and is preferably approx. 1.3 mm, while the thickness of the printing plate body is preferably between 0.5 and 0.7 mm. In practice, the height h preferably may be less than twice the thickness d of the printing plate body 6**.

The means for mechanically stiffening the printing plate body 6 therein disclosed include a thickening 11 or **11*a* of the printing plate body extending along the third or fourth edge 9' or 10' and being delimited on an external or one side by a first surface 13 forming a part of a major plane surface 8 of the printing plate body and being delimited on an opposite or internal side by a second surface 14 extending at a distance from the first surface 13** and being inclined at an acute angle $\alpha$ to that first surface.

According to a preferred embodiment of the invention, the means for mechanically stiffening the printing plate body 6 include a thickening 11 of that printing plate body extending along its third or fourth edge 9' or 10' and including two joining segments 11*a* and 11*b* having surfaces 14, 14' inside the wrap-on printing plate structure inclined at different angles $\alpha$ and $\alpha'$ relative to an outer surface 8 of that printing plate structure.

As seen in FIG. 4, both segments 11*a* and 11*b* of the thickenings 11 are limited on their external side by means of first surfaces 13 and 13' respectively, which form part of the outer surface 8 of the printing plate body 6. On the lower or inner side of the printing plate body 6 the boundaries of the segments 11*a* and 11*b* of the thickening 11 are being defined by means of second surfaces 14 and 14', respectively, which are inclined with respect to the first mentioned surfaces 13 and 13' at different angles $\alpha$ and $\alpha'$, respectively.

As apparent from FIG. 4, angle $\alpha$ is larger than the angle $\alpha'$. This means that the rate of increase of the thickness at the outer segment 11*a* is larger than at the inside segment 11*b*. The inside of the thickening 11 as formed by the two surfaces 14 and 14' is thus provided with a bend or corner A at their transition. The width b of the thickening 11 is less than 10 mm and is preferably approximately 6 mm. The outermost segment 11*a* preferably has a width b' of less than 5 mm, preferably approx. 4 mm.

The relatively thin printing plate bodies 6 are being reinforced at their rims 9 and 10 extending circumferentially of the printing cylinder, by the thickenings 11. These reinforcements avoid a bulging of these plate edge regions 9 and 10. By bending the inner limiting surfaces 14 and 14' of the thickenings 11 at corner A the stiffening effect of these thickenings 11 is further increased. Since, because of these thickenings 11, the height h of the abutment surfaces 12 and 12' is greater than the thickness d of the printing plates 6, these abutting surfaces 12 and 12', despite the thinness of the printing plate body, still have dimensions that permit the formation of these abutting surfaces as precisely plane and rectangular with respect to the plate surface 8.

It is thus possible to join adjacent wrap-on printing form elements 3 and 3'' or 3' and 3''' such that their mutual sealing surfaces 12 and 12' are joined tightly (in FIGS. 3 and 4, for the sake of clarity only, the two wrap-on printing form elements 3, 3''' are positioned a distance from each other; but see FIG. 1).

The above mentioned precise finishing and orientation of the abutting surfaces 12 and 12' and the thickening of the printing plate bodies 6 on their lateral margins 9 and 10, preventing a bulging of the printing plates, allows a flawless sealing of the butt joint S (FIG. 1), whereby intrusion of printing ink inbetween the wrap-on printing form elements 3, 3'' and 3', 3''' is effectively inhibited. The plate edge regions 9 and 10 are not protruding and a smooth transition exists between adjacent wrap-on printing form elements 3, 3'' and 3', 3'''. The butt joints S are thus barely noticeable and cannot have an adverse effect on the quality of the printed product.

To this end, the means for mechanically stiffening the printing plate body along the fourth edge 10' preferably have a configuration representing a mirror image of the means for mechanically stiffening the printing plate body along the third edge 9'. This principle according to preferred embodiments of the subject invention is shown in FIG. 2 for any and each printing plate body 6, and in FIGS. 3 and 4 for adjacent printing plate elements 3 and 3'.

According to a preferred embodiment of the invention also shown in the drawings, the means for mechanically stiffening the printing plate body 6 include an acutely angled sealing edge 16 extending along the third and/or fourth edge 9', 10' opposite an outer surface 8, 9 or 10 of the wrap-on printing plate structure. This sealing edge prevents intrusion of printing ink inbetween the wrapped-on printing plate and the underlying form cylinder. For optimum stiffness and sealing effect the acutely angled sealing edge 16 is preferably combined with the provision of the above mentioned corner section A extending along said printing plate body 6 parallel to that acutely angled sealing edge 16 at a distance therefrom.

In the illustrated preferred embodiments, the thickenings 11 and the printing plate bodies 6 are provided in one piece. In this respect, the formation of the printing plate 6 including the thickenings 11 may be produced by means of galvanic plating, such as of the type disclosed in my above mentioned U.S. Pat. No. 4,437,942. Most advantageously, however the printing plate body 6 with thickenings 11 is formed in one piece of a synthetic, plastic or other suitable material. The clamping bars 7 may thereby be made in one piece with the printing plate body or may otherwise be integral therewith.

The subject invention resides also in a printing plate assembly which comprises the rotary printing form cylinder 2, a first flexible wrap-on printing plate structure 3 attached to that rotary printing form cylinder along first and second edges of that first printing plate, and a second flexible wrap-on printing plate structure 3'' attached to the rotary printing form cylinder along first and second edges of that second printing plate structure and abutting along a third edge 10' of that second printing plate structure a third edge 9' of the first printing plate structure extending between the above mentioned first and second edges of that first printing plate structure. As before, a first thickening 11 or other means extend along the third edge 9' of the first printing plate structure and abut the form cylinder 2 for mechanically stiffening that first printing plate structure along that third edge 9' of the first printing plate structure. Similarly, a further thickening or other means extend along the third edge 10' of the second printing plate structure and abut the form cylinder for mechanically stiffening the second printing plate structure along the third edge 10' of that second printing plate structure.

As seen in FIG. 4, the means for mechanically stiffening the first printing plate structure 3 includes a first acutely angled sealing edge 16 abutting the form cylinder 2, and the means for mechanically stiffening the second printing plate structure 3'' includes a second acutely angled sealing edge 16 abutting the form cylinder 2.

According to a preferred embodiment of this invention, the form cylinder 2 has a first recess for receiving the sealing edge 16 of the printing plate body 6 of structure 3, and a second recess for receiving the corresponding sealing edge 16 of printing plate body 6 of structure 3''. The mentioned first recess 2' for also accommodating the first thickening 11 in the form cylinder 2 is seen in FIG. 1. However, in order to avoid obfuscation of the enlarged view, FIG. 4 indicates the presence of the form cylinder only by an arrow 2, and shows the mentioned first and second recesses in the form cylinder 2 only by dotted lines at 2', representing the profile of the recesses accommodating the thickenings 11 of the printing plate structures 3 and 3'' in the form cylinder 2.

In FIG. 4, the plate structures 3 and 3'' are shown separated from each other at B for clearer illustration. However, these plate structures actually abut each other tightly at the lateral abutment surfaces 12 and 12' when mounted on the form cylinder 2 having recesses 2'.

Recesses (covered in FIG. 1) corresponding to recess 2' are provided in the form cylinder 2 also inside along flanges 4 and 4' for an accommodation of the outside thickenings 11 and sealing edges 16 of the printing plate structures 3 to 3'''.

Intrusion of printing ink at the printing plate butt joints S is thus effectively inhibited, inasmuch as the thickenings 11 and/or corner A prevent warping of the printing plates at their edge regions 9 and 10. This has the added advantage that there will be no uneveness or other discontinuity among the clamped-on printing plates. Moreover, the projecting sealing edges 16 keep all ink away from the form cylinder recesses 2' so that no reservoir for undesired ink that could mar the printing process can form.

The gradual configurations of the thickenings 11 convey manufacturing advantages on the wrap-on printing plate structures according to the subject invention.

The flexible wrap-on printing plates or blanks herein shown may be provided in a conventional manner with the image and text information to be printed therefrom. For instance, in the case of intaglio or rotogravure type of printing, the wrap-on blank may be etched or engraved in a conventional manner.

The subject extensive disclosure will suggest or render apparent to those skilled in the art various modifications and variations within the spirit and scope of the subject invention and equivalents thereof.

I claim:

1. A printing plate assembly, comprising in combination:

a rotary printing form cylinder;

a first flexible wrap-on printing plate structure having a first flexible printing plate body extending between opposite first and second edges of said first printing plate structure and being attached to said rotary printing form cylinder along said first and second edges of said first printing plate structure;

a second flexible wrap-on printing plate structure having a second flexible printing plate body extending between opposite first and second edges of said second printing plate structure and being attached to said rotary printing form cylinder along said first and second edges of said second printing plate structure and abutting along a third edge of said second printing plate structure a third edge of said first printing plate structure extending between said first and second edges of said first printing plate structure;

means extending along said third edge of said first printing plate structure and abutting said form cylinder for mechanically stiffening said first printing plate structure along said third edge of the first printing plate structure including a first thickening of said first printing plate structure along said third edge of the first printing plate structure having a first lateral abutment surface of a height greater than a thickness of said first printing plate body; and means extending along said third edge of said second printing plate structure and abutting said form cylinder for mechanically stiffening said second printing plate structure along said third edge of the second printing plate structure including a second thickening of said second printing plate structure along said third edge of the second printing plate structure having a second lateral abutment surfaces abutting said first lateral abutment surface and having a height greater than a thickness of said second printing plate body.

2. A printing plate assembly as claimed in claim 1, wherein:

said second thickening has a configuration representing a mirror image of said first thickening.

3. A printing plate assembly as claimed in claim 1, wherein:

said first thickening has a configuration constituting a first acutely angled sealing edge abutting said form cylinder; and said second thickening has a configuration constituting a second acutely angled sealing edge abutting said form cylinder.

4. A printing plate assembly as claimed in claim 1, wherein:

said means for mechanically stiffening said first printing plate structure include a first acutely angled sealing edge abutting said form cylinder; and said means for mechanically stiffening said second printing plate structure include a second acutely angled sealing edge abutting said form cylinder.

5. A printing plate assembly as claimed in claim 4, wherein:

said form cylinder has a first recess for receiving said first sealing edge in sealing engagement; and said form cylinder has a second recess for receiving said second sealing edge in sealing engagement.

6. A printing plate assembly as claimed in claim 1 wherein:

said form cylinder has a first recess accommodating said first thickening; and said form cylinder has a second recess accommodating said second thickening.

7. A printing plate assembly as claimed in claim 1, wherein:

said means for mechanically stiffening said first printing plate structure and said means for mechanically stiffening said second printing plate structure include first and second corner sections, respectively extending along said first and second printing plate structures in parallel to and at a distance from said third edges.

8. A printing plate assembly as claimed in claim 1, wherein:

said means for mechanically stiffening said first printing plate structure and said means for mechanically stiffening said second printing plate structure each include a pair of successive different thickening extending jointly along said third edges of said first and second printing plate structures, respectively.

9. A printing plate assembly as claimed in claim 8, wherein:

one of the thickenings of each pair extends from the other thickening of that pair to the adjacent third edge and is stronger than said other thickening of that pair.

* * * * *